US011319654B2

(12) United States Patent
Malone et al.

(10) Patent No.: US 11,319,654 B2
(45) Date of Patent: May 3, 2022

(54) WASHING MACHINE APPLIANCE HAVING ONE OR MORE VENTILATION FEATURES

(71) Applicant: Haier US Appliance Solutions, Inc., Wilmington, DE (US)

(72) Inventors: S. Neil Malone, Louisville, KY (US); Kenneth G. Rudolph, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 392 days.

(21) Appl. No.: 16/388,935

(22) Filed: Apr. 19, 2019

(65) Prior Publication Data

US 2020/0332451 A1 Oct. 22, 2020

(51) Int. Cl.

| | |
|---|---|
| ***D06F 35/00*** | (2006.01) |
| ***D06F 37/04*** | (2006.01) |
| ***D06F 37/26*** | (2006.01) |
| ***D06F 39/12*** | (2006.01) |
| ***D06F 39/14*** | (2006.01) |

(52) U.S. Cl.

CPC ..... *D06F 35/00* (2013.01); *D06F 35/008* (2013.01); *D06F 37/04* (2013.01); *D06F 37/267* (2013.01); *D06F 39/12* (2013.01); *D06F 39/14* (2013.01)

(58) Field of Classification Search

None

See application file for complete search history.

(56) References Cited

U.S. PATENT DOCUMENTS

| | | | | |
|---|---|---|---|---|
| 4,006,534 | A | 2/1977 | Coffman | |
| 4,231,166 | A | 11/1980 | McMillan | |
| 6,000,248 | A | 12/1999 | Erickson et al. | |
| 7,371,789 | B2 | 5/2008 | Sin | |
| 7,614,261 | B2 | 11/2009 | Oh et al. | |
| 7,810,360 | B2 | 10/2010 | Kim et al. | |
| 8,020,412 | B2 | 9/2011 | Kim et al. | |
| 2005/0265890 | A1 | 12/2005 | Yang et al. | |
| 2008/0078210 | A1* | 4/2008 | Kim | D06F 35/00 68/4 |
| 2008/0264112 | A1 | 10/2008 | Son et al. | |
| 2011/0139190 | A1 | 6/2011 | Northrup | |

FOREIGN PATENT DOCUMENTS

| | | | |
|---|---|---|---|
| CN | 107059327 | A | 8/2017 |

* cited by examiner

*Primary Examiner* — Levon J Shahinian

(74) *Attorney, Agent, or Firm* — Dority & Manning, P.A.

(57) ABSTRACT

A washing machine appliance, as provided herein, may include a cabinet, a tub, a wash basket, a ventilation line, and an antimicrobial body. The cabinet may include a front panel defining an opening. The tub may be positioned within the cabinet. The wash basket may be rotatably mounted within the tub. The wash basket may define a wash chamber for receiving articles for washing. The ventilation line may be in fluid communication with the tub. The ventilation line may define an air path from a ventilation inlet within the cabinet. The air path may extend to a ventilation outlet in fluid communication with an ambient environment outside of the cabinet. The antimicrobial body may be positioned along the ventilation line.

20 Claims, 7 Drawing Sheets

WASHING MACHINE APPLIANCE HAVING ONE OR MORE VENTILATION FEATURES

FIELD OF THE INVENTION

The present subject matter relates generally to washing machine appliances, and more particularly to washing machine appliances having one or more ventilation features.

BACKGROUND OF THE INVENTION

Washing machine appliances generally include a wash tub for containing water or wash fluid (e.g., water, detergent, bleach, or other wash additives). A basket is rotatably mounted within the wash tub and defines a wash chamber for receipt of articles for washing. During normal operation of such washing machine appliances, the wash fluid is directed into the wash tub and onto articles within the wash chamber of the basket. The basket or an agitation element can rotate at various speeds to agitate articles within the wash chamber, to wring wash fluid from articles within the wash chamber, etc.

Some existing washing machine appliances, such as horizontal axis washing machines, are provided with one or more ventilation features. Such features may allow a washing machine appliance to exchange air between the wash tub and the ambient environment. The exchange of air may be necessary to prevent moisture from accumulating within the tub. For example, if the tub is not ventilated, moist, stagnant air may form within the washing machine.

Although ventilation features may aid in preventing moisture from accumulating within existing washing machine appliances (e.g., when a door to the washing machine is open), such existing appliances may have certain disadvantages. For example, airflow through such washing machine appliances is generally limited, especially when the door is closed. Although leaving the door to the tub open may improve airflow, and thereby help prevent moisture from accumulating, this may undesirable for various reasons. For instance, leaving the door open may limit usable space within a room or make it impossible to cover or hide the washing machine appliance. Moreover, leaving the washing machine appliance door open may be inconvenient or create an unseemly appearance. Even if a door to a washing machine appliance is left open, moisture may still become trapped in certain portions of the washing machine appliance or ventilation features.

As a result, further advances are necessary to improve performance and reduce residual moisture within washing machine appliances. In particular, it may be advantageous to provide one or more features for aiding in ventilation or reducing the accumulation of residual moisture within a washing machine appliance.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a washing machine appliance is provided. The washing machine appliance may include a cabinet, a tub, a wash basket, a ventilation line, and an antimicrobial body. The cabinet may include a front panel defining an opening. The tub may be positioned within the cabinet. The wash basket may be rotatably mounted within the tub. The wash basket may define a wash chamber for receiving articles for washing. The ventilation line may be in fluid communication with the tub. The ventilation line may define an air path from a ventilation inlet within the cabinet. The air path may extend to a ventilation outlet in fluid communication with an ambient environment outside of the cabinet. The antimicrobial body may be positioned along the ventilation line.

In another exemplary aspect of the present disclosure, a washing machine appliance is provided. The washing machine appliance may include a cabinet, a door, a tub, a wash basket, a ventilation line, and an antimicrobial body. The cabinet may include a front panel defining an opening and a cabinet aperture spaced apart from the opening. The door may be movably attached to the cabinet to move between an open position and a closed position. The door in the open position may permit access to the opening. The door in the closed position may define a footprint on the front panel covering the opening and the cabinet aperture. The tub may be positioned within the cabinet. The tub may be in fluid communication with an ambient environment through the cabinet aperture in the closed position. The wash basket may be rotatably mounted within the tub. The wash basket may define a wash chamber for receiving articles for washing. The ventilation line may be in fluid communication with the tub. The ventilation line may define an air path from a ventilation inlet within the cabinet. The air path may extend to a ventilation outlet in fluid communication with an ambient environment outside of the cabinet. The antimicrobial body may be positioned along the ventilation line.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
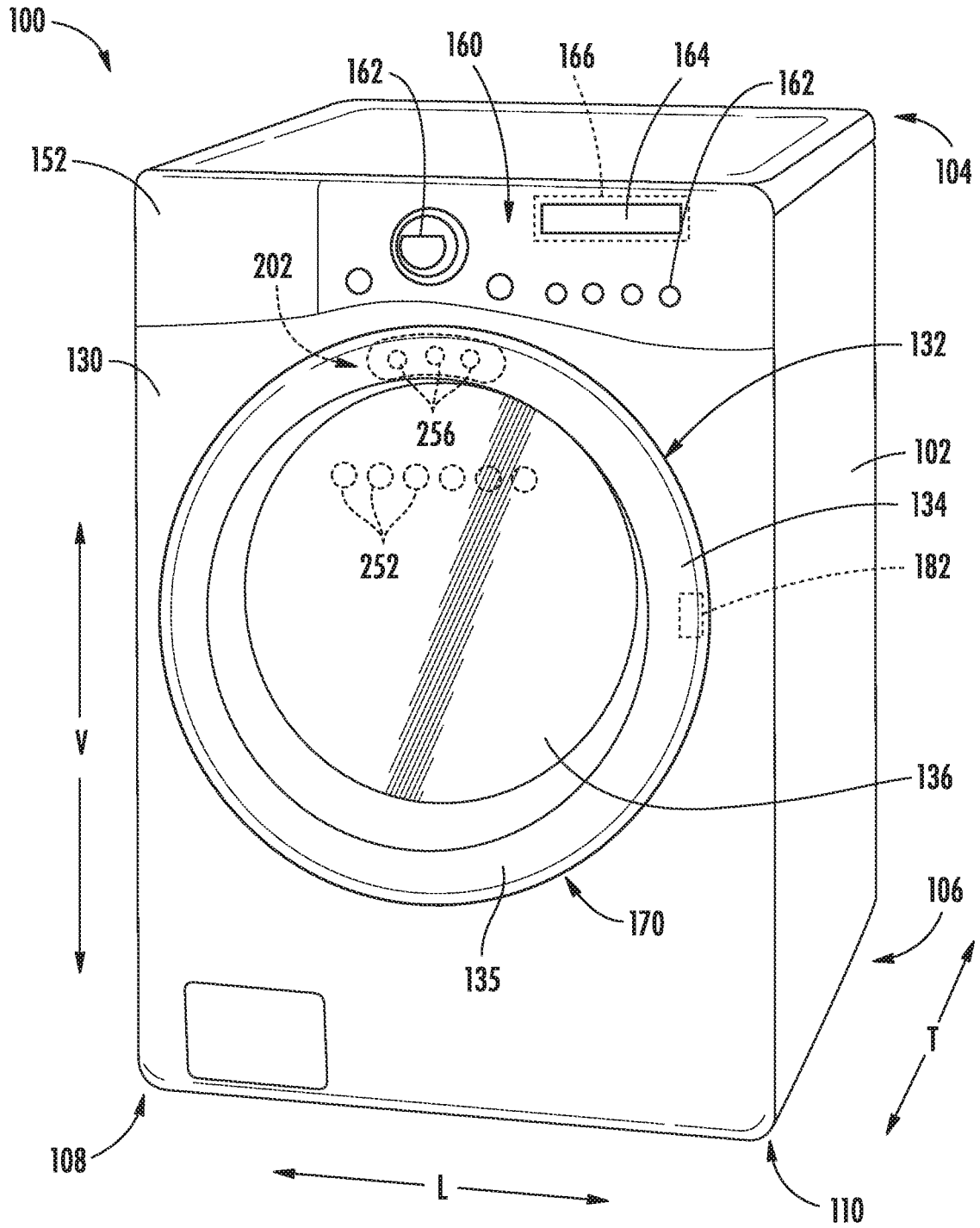
FIG. 1 provides a perspective view of a washing machine appliance according to exemplary embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Within the present disclosure, the term "or" is generally intended to be inclusive (i.e., "A or B" is intended to mean "A or B or both"). The terms "first," "second," and "third" may be used interchangeably to distinguish one element from another and are not intended to signify location or importance of the individual elements. The terms "upstream" and "downstream" refer to the relative flow direction with respect to fluid flow in a fluid pathway. For example, "upstream" refers to the flow direction from which the fluid flows, and "downstream" refers to the flow direction to which the fluid flows.

Figure 2:
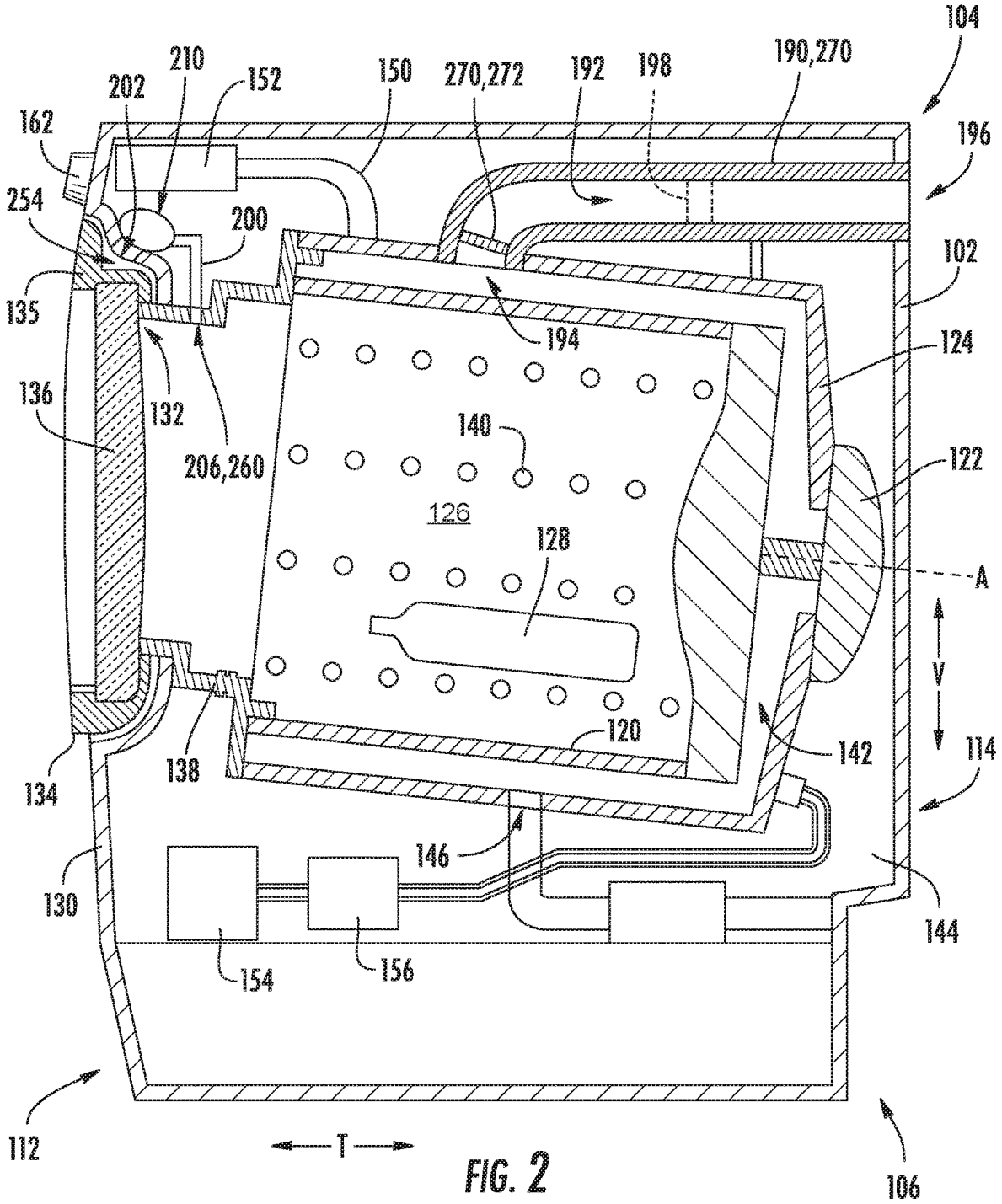
FIG. 2 provides a cross-sectional side view of the exemplary washing machine appliance of FIG. 1.
Figure 3:
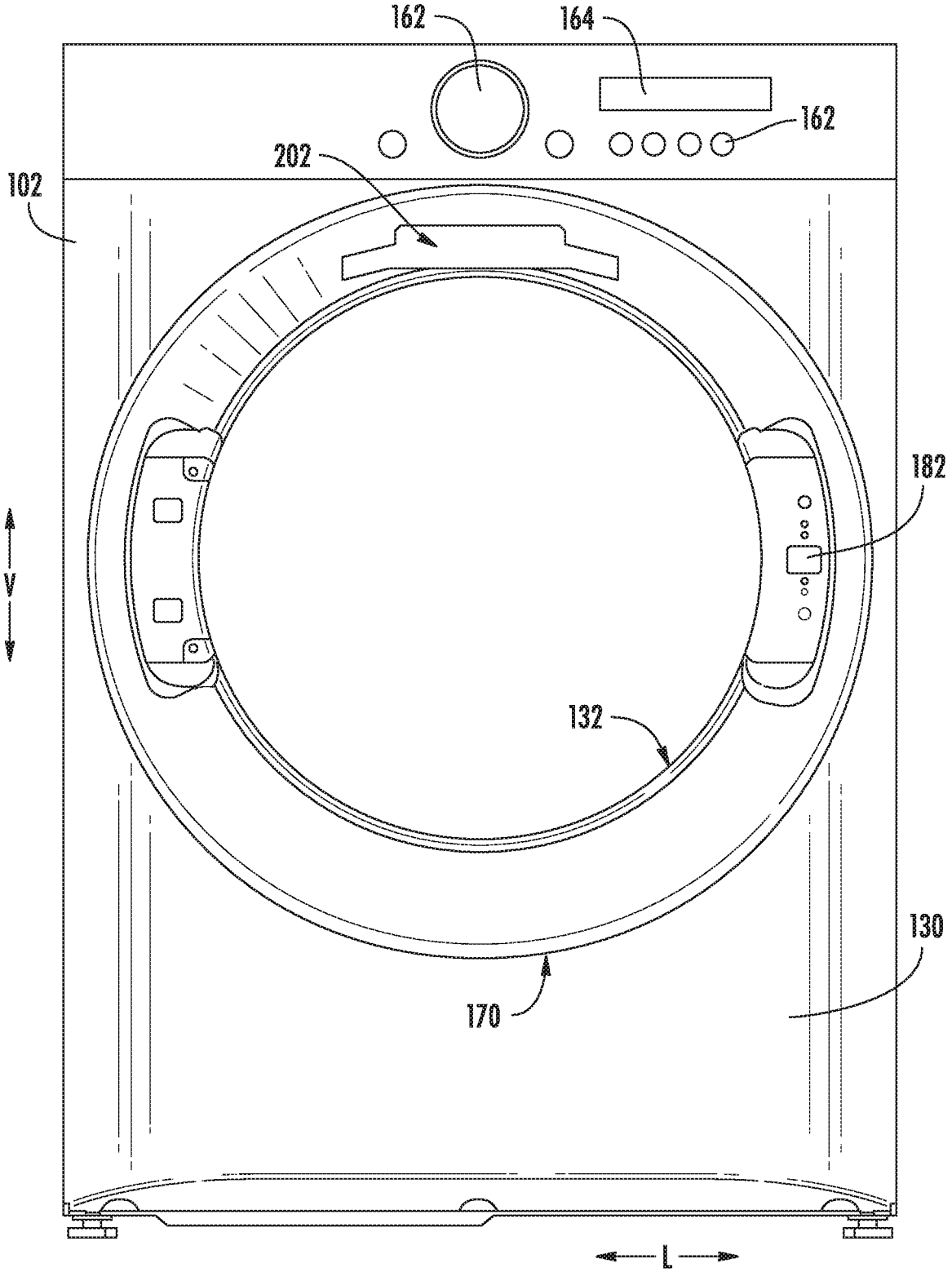
FIG. 3 provides a front view of the exemplary washing machine appliance of FIG. 1, wherein the door has been removed for clarity.

Referring now to the figures, FIG. 1 is a perspective view of an exemplary washing machine appliance 100. FIG. 2 is a side cross-sectional view of washing machine appliance 100. FIG. 3 provides a front view of washing machine appliance 100, wherein a door 134 (FIG. 2) has been removed for clarity. As illustrated, washing machine appliance 100 generally defines a vertical direction V, a lateral direction L, and a transverse direction T, each of which is mutually perpendicular, such that an orthogonal coordinate system is defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 2, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiments, the axis of rotation A is substantially parallel (e.g., within 30°) relative to the transverse direction T. In this regard, washing machine appliance 100 is generally referred to as a "horizontal axis" or "front load" washing machine appliance 100. However, it is noted that the illustrated embodiments are provided merely as non-limiting examples and the present disclosure may be applicable to any other suitable washing machine appliance configuration.

Wash basket 120 may define one or more agitator features that extend into wash chamber 126 to assist in agitation and cleaning articles disposed within wash chamber 126 during operation of washing machine appliance 100. For example, as illustrated in FIG. 2, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiments, motor assembly 122 is a pancake motor. However, it should be appreciated that any suitable type, size, or configuration of motor may be used to rotate wash basket 120 according to alternative embodiments.

Referring generally to FIGS. 1 through 3, cabinet 102 also includes a front panel 130 that defines an opening 132, which generally permits user access to wash basket 120 of wash tub 124. More specifically, washing machine appliance 100 includes a door 134 that is selectively positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 1) prohibiting access to wash tub 124. In exemplary embodiments, a lock assembly 182 is fixed to cabinet 102 to selectively lock or hold a free end of the door 134 to cabinet 102 when door 134 is in the closed position (e.g., during certain operations or wash cycles).

In some embodiments, a central body 136 of door 134 is provide on a perimeter rim 135 that extends about (e.g., radially about) at least a portion of central body 136. In optional embodiments, central body 136 is provided as a window and permits viewing of wash basket 120 when door 134 is in the closed position (e.g., during operation of washing machine appliance 100). Generally, door 134 defines a footprint 170 on a front portion of cabinet 102 (e.g., in a plane defined by the lateral direction L and the transverse direction T). For instance, when door 134 is in the closed position, central body 136 and perimeter rim 135 may extend across footprint 170 and thus cover the area of the front panel 130 within footprint 170 (e.g., when viewed along the transverse direction T directly in front of washing machine appliance 100). As shown, particularly in FIG. 3, footprint 170 may extend radially outward from opening 132. Thus, footprint 170 may encompass and define a larger width (e.g., diameter) than opening 132. In some such embodiments, central body 136 extends across and, optionally, within opening 132. Perimeter rim 135 may extend radially outward from opening 132 and define the extrema of footprint 170.

In certain embodiments, central body 136 is provided as a non-permeable body, which blocks or prevents wash fluid or air from passing therethrough. In alternative embodiments, central body 136 defines one or more air apertures 252 (illustrated in phantom lines) therethrough. Each air aperture 252 may extend fully through central body 136 (e.g., in the transverse direction T) and permit fluid communication (e.g., an airflow) between wash tub 124 and the ambient environment when door 134 is in the closed position. As illustrated, it may be desirable that air apertures 252 are positioned proximate top 104 of washing machine appliance 100 or proximate a top portion of wash tub 124 such that wash fluid is less likely to splash through air apertures 252 during a wash or rinse cycle.

Door 134 may also include a handle (not shown) that, for example, a user may pull when opening 132 and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle 138 may extend between tub 124 and the front panel 130 about the opening 132 covered by door 134, further sealing tub 124 from cabinet 102. For example, when door 134 is in the closed position, baffle 138 may contact central body 136 in sealing engagement therewith and within footprint 170.

As shown, wash basket 120 defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through plurality of perforations 140. A pump assembly 144 is located beneath wash tub 124 for gravity assisted flow when draining wash tub 124 (e.g., via a drain 146). Pump assembly 144 may also be configured for recirculating wash fluid within wash tub 124.

In some embodiments, washing machine appliance 100 includes an additive dispenser or spout 150. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during certain operations or wash cycle phases of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

Figure 4:
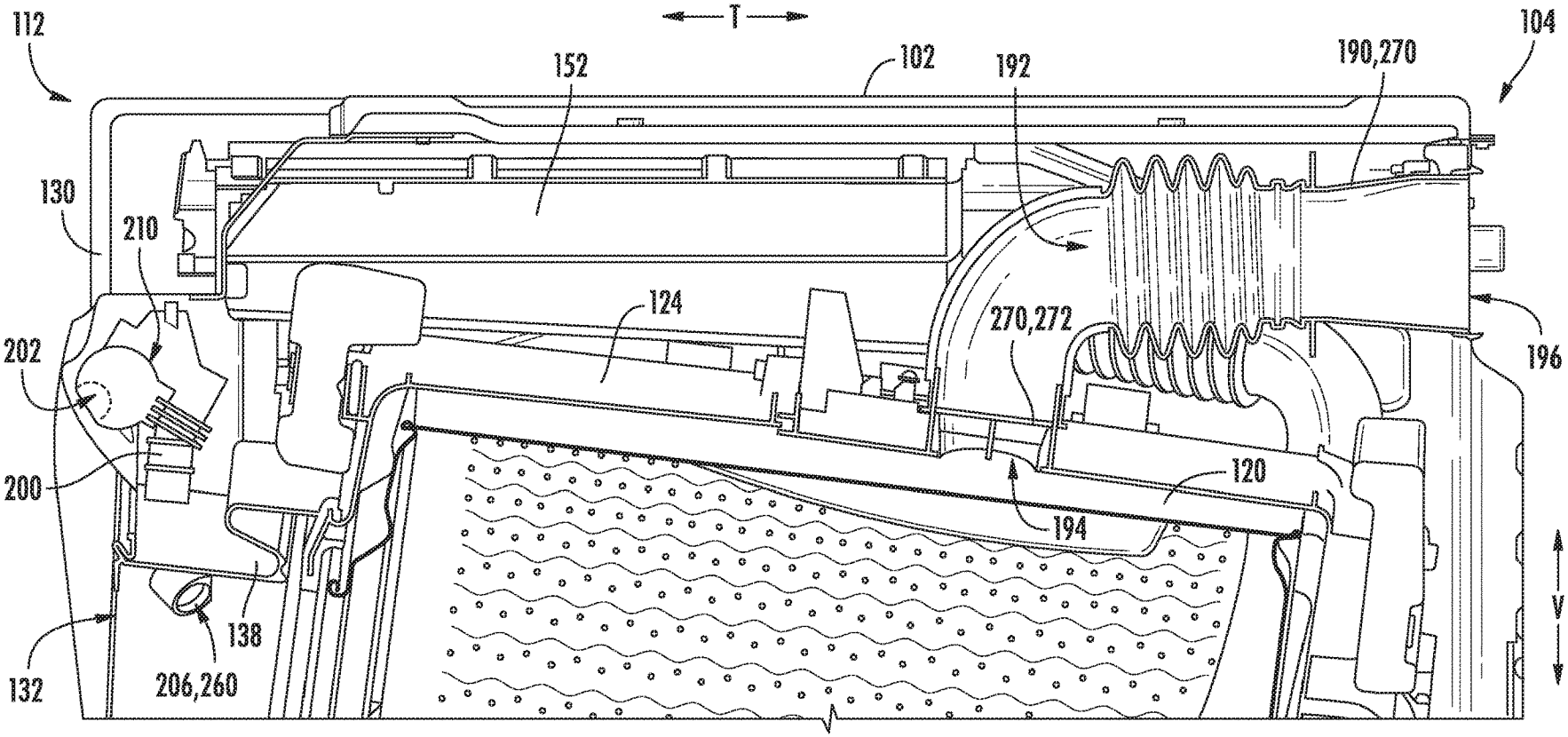
FIG. 4 provides a magnified, cross-sectional, side view of a portion the exemplary washing machine appliance of FIG. 1.

In some embodiments, a ventilation line 190 is provided within washing machine appliance 100. In particular, ventilation line 190 may be enclosed within cabinet 102. As shown in FIGS. 2 and 4, exemplary embodiments include ventilation line 190 at a position in fluid communication between tub 124 and the surrounding region (e.g., the ambient environment outside of or immediately surrounding cabinet 102, the enclosed volume of cabinet 102 surrounding tub 124, etc.). Generally, it is understood that ventilation line 190 may be provided as any suitable pipe or conduit (e.g., having non-permeable wall) for directing air therethrough. When assembled, ventilation line 190 defines an air path 192 from tub 124 and within or through cabinet 102 (e.g., to the ambient environment outside of cabinet 102). Specifically, air path 192 extends from a ventilation inlet 194, through cabinet 102, and to a ventilation outlet 196. In some embodiments, ventilation inlet 194 is defined through a top portion of wash tub 124 and ventilation outlet 196 is defined through an upper portion of cabinet 102. Thus, air path 192 may extend from the top portion of tub 124 to an upper portion of cabinet 102. Optionally, ventilation inlet 194 may be positioned below ventilation outlet 196 along a vertical direction V. Advantageously, a convective airflow may be naturally motivated from wash tub 124, through air path 192, and to the ambient environment. Additionally or alternatively, splashing of wash fluid and the collection of moisture within air path 192 may be prevented. However, any other suitable configuration may be provided to facilitate the flow of air from tub 124 and, for example, to the ambient environment.

Although a convective airflow may be facilitated, optional embodiments further include a fan or blower 198 (indicated in phantom lines). Specifically, fan 198 may be provided in fluid communication with ventilation line 190 to motivate an active airflow therethrough. For instance, fan 198 may be mounted within ventilation line 190 to selectively rotate and draw air from wash tub 124, through ventilation inlet 194, and to ventilation outlet 196 (e.g., to output an airflow from tub 124 to the ambient environment).

In certain embodiments, a secondary line 200, separate and spaced apart from ventilation line 190, is provided in fluid communication with wash tub 124. For instance, secondary line 200 may be any suitable pipe or conduit in fluid communication (e.g., upstream fluid communication) with wash tub 124 and ventilation line 190. As shown, in exemplary embodiments, secondary line 200 extends from front panel 130 to wash tub 124.

A cabinet aperture 202 may be defined through front panel 130 as an inlet for ambient air to flow to ventilation line 190 and into tub 124 through a corresponding outlet 206. In some such embodiments, cabinet aperture 202 is defined within the footprint 170 of door 134. Thus, when door 134 is in the closed position, cabinet aperture 202 may be generally covered and hidden from view. As shown, even though door 134 is in the closed position, a gap 254 may be defined between at least a portion of door 134 and cabinet aperture 202 to create a flow path for air from the ambient environment to cabinet aperture 202. In other words, one portion of door 134 (e.g., perimeter rim 135) may be spaced apart from cabinet aperture 202 while another portion of door 134 (e.g., central body 136) blocks opening 132 and contacts baffle 138. In additional or alternative embodiments, one or more secondary apertures 256 may be defined through door 134 (e.g., through perimeter rim 135 along the transverse direction T) and in alignment with cabinet aperture 202. In such embodiments, air may pass between secondary aperture 256 and cabinet aperture 202 (e.g., from the ambient environment) when door 134 is in the closed position.

Notably, in the disclosed embodiments, air (e.g., an ambient airflow) may flow between tub 124 and the ambient environment through cabinet aperture 202 even while door 134 remains closed.

As noted above, secondary line 200 may provide a corresponding outlet 206 in fluid communication with tub 124. In exemplary embodiments, outlet 206 is defined through baffle 138. For instance, as shown, outlet 206 may be defined as a radial aperture 260 extending through baffle 138 (e.g., along the vertical direction V or otherwise radially outward from opening 132). Additionally or alternatively, outlet 206 may be positioned below the cabinet aperture 202 or the remaining portion of secondary line 200.

In optional embodiments, a vent damper 210 is provided to selectively control an airflow between tub 124 and, for example, the ambient environment. Generally, vent damper 210 is in communication with wash tub 124 or ventilation line 190 (i.e., in fluid communication with air path 192). In certain embodiments, vent damper 210 is enclosed, at least in part, within cabinet 102 (e.g., within line 190 or 200). For instance, vent damper may be positioned along secondary line 200. As will be described in detail below, vent damper 210 may be selectively controlled or operated to limit the flow of air through secondary line 200 (e.g., and thereby through ventilation line 190 or air path 192) during certain operations, phases, or cycles. Thus, vent damper 210 may selectively limit airflow between tub 124 and the ambient environment.

When secondary line 200 is unobstructed (e.g., when vent damper 210 is in an open second position), air may flow to/from tub 124 between secondary line 200 and ventilation line 190. In other words, an airflow circuit with the ambient environment may be formed by the lines 190, 200 and tub 124. Moreover, when one line (e.g., secondary line 200 or ventilation line 190) is obstructed, the other line (e.g., ventilation line 190 or secondary line 200) may permit pressure within tub 124 to equalize relative to the ambient environment.

In certain embodiments, one or more antimicrobial bodies 270 are provided in fluid communication with ventilation line 190 or air path 192. Generally, an antimicrobial body 270 includes (e.g., is coated with or impregnated with) an antimicrobial material that acts to destroy virus, bacteria, or fungi cells (e.g., via a chemical or cell-abrasive reaction), such as those that would produce odors in the presence of water or water vapor. For instance, as is understood, suitable antimicrobial materials may include a metal (e.g., silver or copper, including alloys thereof) or organosilane compound. Optionally, suitable antimicrobial materials may be sold under the MICROBAN® brand or label.

In certain embodiments, antimicrobial body 270 is positioned along ventilation line 190. As an example, antimicrobial body 270 may extend across ventilation line 190 (e.g., non-parallel or perpendicular to a portion of air path 192). Thus, airflow through ventilation line 190 may pass through or across antimicrobial body 270. Antimicrobial body 270 may be provided as an air-permeable mesh 272 that is formed, at least in part, by antimicrobial material, as described above. The air-permeable mesh 272 may be positioned or located between the ventilation inlet 194 and the ventilation outlet 196. Optionally, the air-permeable mesh 272 may include a nylon, or other suitable polymer, impregnated with antimicrobial material. As an additional or alternative example, antimicrobial body 270 may form at least a portion of ventilation line 190 (e.g., to define a portion of the air path 192). For instance, antimicrobial body 270 may be included with the structure of ventilation line and thereby serve to define air path 192 from ventilation inlet 194 to ventilation outlet 196.

In some embodiments, a control panel 160 including a plurality of input selectors 162 is coupled to front panel 130. Control panel 160 and input selectors 162 may collectively form a user interface input for operator selection of machine cycles and features. For example, in exemplary embodiments, a display 164 indicates selected features, a countdown timer, or other items of interest to machine users.

Operation of washing machine appliance 100 is generally controlled by a controller or processing device 166. In some embodiments, controller 166 is in operative communication with (e.g., electrically or wirelessly connected to) control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122, fan 198, and vent damper 210, may be in operative communication with controller 166 via one or more signal lines or shared communication busses. Additionally or alternatively, other features, such as an electronic lock assembly 182 for door 134 may be in operative communication with controller 166 via one or more other signal lines or shared communication busses.

In exemplary embodiments, during operation of washing machine appliance 100, laundry items are loaded into wash basket 120 through opening 132, and a wash cycle is initiated through operator manipulation of input selectors 162. For example, a wash cycle may be initiated such that wash tub 124 is filled with water, detergent, or other fluid additives (e.g., via additive dispenser 150 during a fill phase). One or more valves (not shown) can be controlled by washing machine appliance 100 to provide for filling wash basket 120 to the appropriate level for the amount of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., first speed or tumble speed). As the basket 120 is rotated, articles within the basket 120 may be lifted and permitted to drop therein.

After the agitation phase of the washing operation or wash cycle is completed, wash tub 124 can be drained (e.g., through a drain phase). Laundry articles can then be rinsed (e.g., through a rinse phase) by again adding fluid to wash tub 124, depending on the particulars of the wash cycle selected by a user. Ribs 128 may again provide agitation within wash basket 120. One or more spin phases may also be used. In particular, a spin phase may be applied after the wash cycle or after the rinse cycle in order to wring wash fluid from the articles being washed. During a spin phase, basket 120 is rotated at relatively high speeds. For instance, basket 120 may be rotated at one set speed (e.g., second speed or pre-plaster speed) before being rotated at another set speed (e.g., third speed or plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the wash cycle otherwise ends), a user can remove the articles from wash basket 120 (e.g., by opening door 134 and reaching into wash basket 120 through opening 132).

Figure 5:
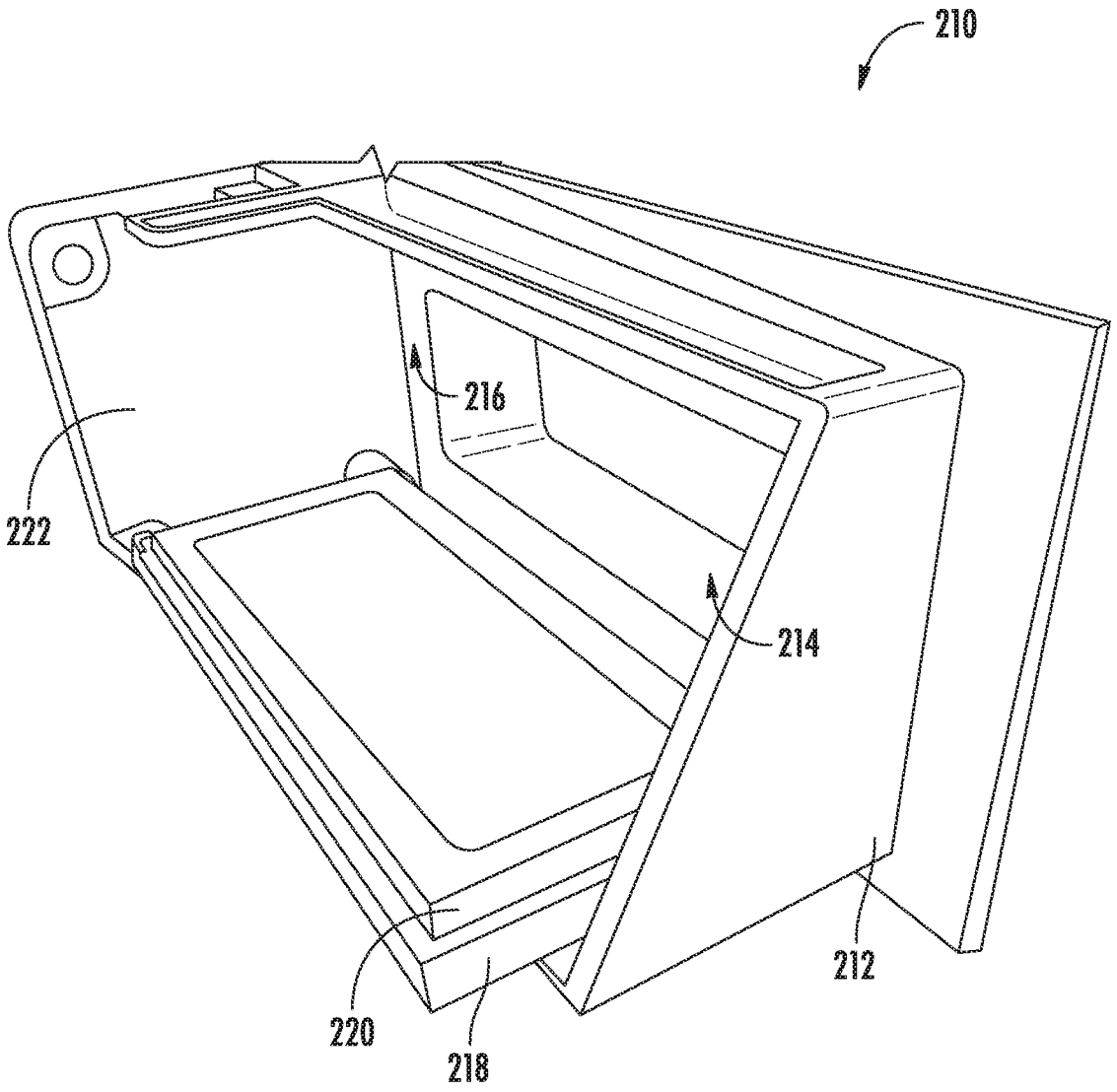
FIG. 5 provides a perspective view of a damper assembly according to exemplary embodiments of the present disclosure.
Figure 6:
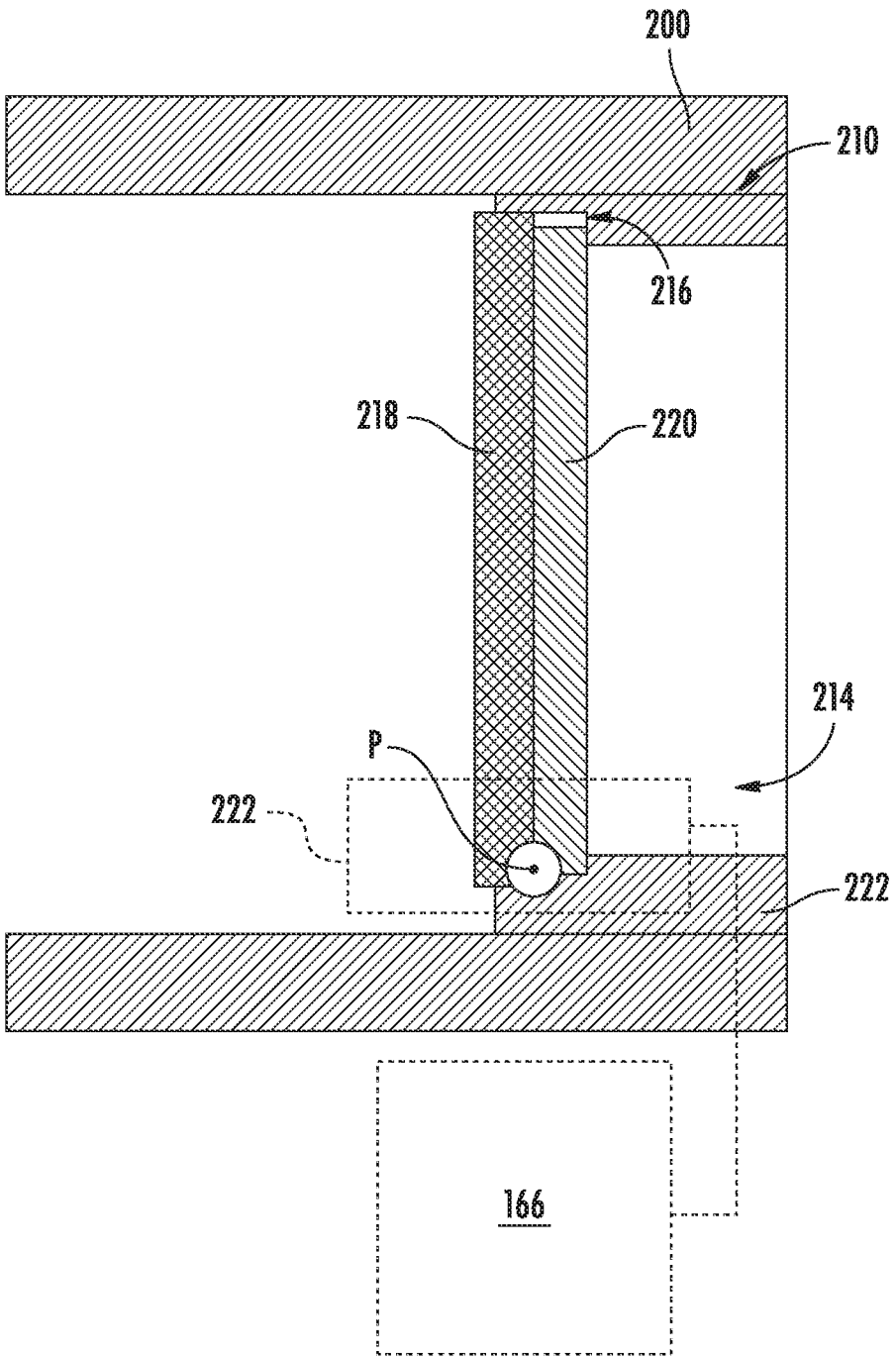
FIG. 6 provides a cross-sectional schematic view of the exemplary damper assembly of FIG. 5 in a closed first position.
Figure 7:
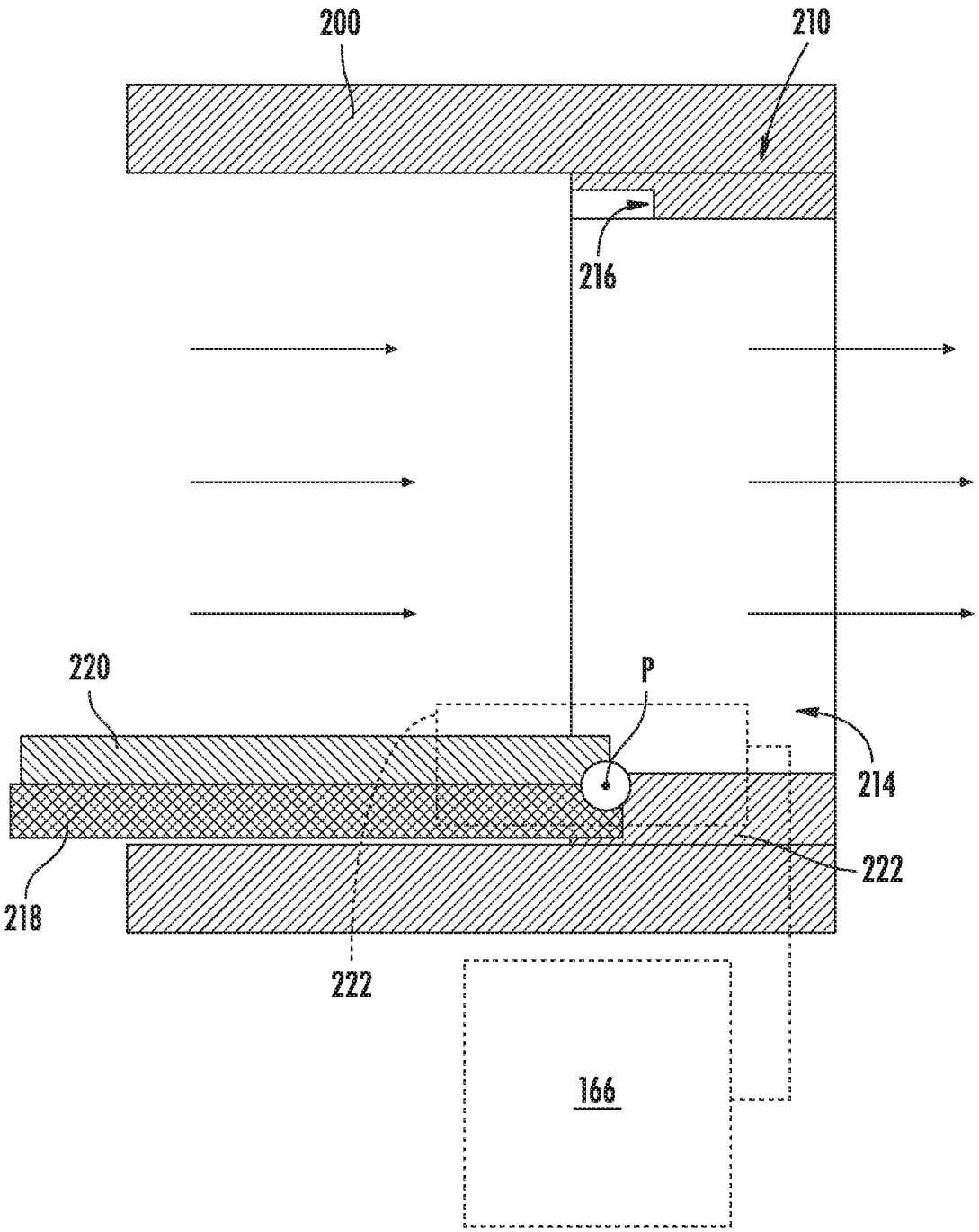
FIG. 7 provides a cross-sectional schematic view of the exemplary damper assembly of FIG. 5 in an open second position.

Turning now to FIGS. 5 through 7, various views are provided of a damper assembly (e.g., vent damper 210) according to exemplary embodiments of the present disclosure. As shown, vent damper 210 may include a rigid, non-permeable housing or chute 212. Chute 212 may define an opening 214 to selectively permit air therethrough and communicate with ventilation line 190 (e.g., via secondary line 200—FIG. 4). Thus, chute 212 may extend about opening 214, and opening 214 may extend through chute 212. In certain embodiments, an interior lip 216 extends radially inward from chute 212 toward opening 214 (e.g., coaxial or concentric with opening 214), thus defining a perimeter (or perimeter portion) of opening 214.

When assembled in optional embodiments, chute 212 may be positioned along within secondary line 200. Secondary line 200 may be mated to chute 212. For instance, the walls of secondary line 200 may connect directly or indirectly to chute 212. It is understood that when assembled airflow through the secondary line 200 is restricted through opening 214. Thus, any air passing between tub 124 and the ambient environment through ventilation line 190 may be forced to flow through opening 214. This may be especially true when door 134 (FIG. 2) of the washing machine appliance 100 is in the closed position.

In some embodiments, vent damper 210 includes a non-permeable restrictor plate 218. Generally, restrictor plate 218 is movably attached to chute 212. For example, restrictor plate 218 may be rotatably mounted to chute 212 to selectively pivot about a predefined pivot axis P. During use, restrictor plate 218 may be selectively moved (e.g., rotated) in front of or behind opening 214. Thus, restrictor plate 218 may selectively block air passage through opening 214. Moreover, restrictor plate 218 may selectively permit air passage through opening 214.

In certain embodiments, restrictor plate 218 is configured to move between a discrete first position and second position. As illustrated in FIG. 4, the first position generally restricts airflow through opening 214 (e.g., and thereby through secondary line 200 or ventilation line 190). In the first position, restrictor plate 218 may extend across opening 214. By contrast, and as illustrated in FIG. 5, the second position may generally permit airflow through opening 214 (e.g., and thereby through secondary line 200 or ventilation line 190). In the second position, restrictor plate 218 may be moved away from opening 214.

In certain embodiments, a resilient foam layer 220 is provided on restrictor plate 218. For instance, resilient foam layer 220 may be fixed to a surface of restrictor plate 218 between opening 214 and restrictor plate 218 (e.g., relative to or along secondary line 200). When restrictor plate 218 is in the first position, resilient foam layer 220 may contact at least a portion of chute 212. For instance, resilient foam layer 220 may be positioned in contact with interior lip 216. Optionally, resilient foam layer 220 may be at least partially compressed against chute 212, sealing secondary line 200 to prevent air from passing through opening 214. It is understood that resilient foam layer 220 may be provided as any suitable resilient or elastic foam material that can be compressed before returning to its uncompressed state or shape.

Optionally, one or more portion of vent damper 210 includes or is formed by an antimicrobial material, as described above. For instance, chute 212, restrictor plate 218, or resilient foam layer 220 may include an antimicrobial material such that airflow through vent damper is forced across or through the antimicrobial material.

In exemplary embodiments, a motor 222 is mechanically coupled to non-permeable restrictor plate 218. Motor 222 may be attached at any suitable location on or near chute 212 to move restrictor plate 218 relative to opening 214. For instance, motor 222 may be configured to selectively rotate restrictor plate 218 about the pivot access P. Moreover, motor 222 may be provided as any suitable electromechanical device (e.g., gear assembly, solenoid, actuator, etc.) for moving restrictor plate 218 or holding restrictor plate 218 in a directed position. In certain embodiments, motor 222 is in operative communication with (e.g., electrically or wirelessly connected to) controller 166. Controller 166 may be configured to direct motor 222 to move or hold restrictor plate 218 in a selected position (e.g., according to a selected wash cycle or phase). In other words, controller 166 may be configured to move or rotate vent damper 210 between the first position and the second position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A washing machine appliance comprising:

a cabinet including a front panel, the front panel defining an opening;

a tub positioned within the cabinet;

a wash basket rotatably mounted within the tub, the wash basket defining a wash chamber for receiving articles for washing;

a ventilation line in fluid communication with the tub, the ventilation line defining an air path from a ventilation inlet within the cabinet and to a ventilation outlet in fluid communication with an ambient environment outside of the cabinet;

an antimicrobial body positioned along the ventilation line; and a fan positioned within the ventilation line to motivate an airflow therethrough.

2. The washing machine appliance of claim 1, wherein the ventilation inlet is positioned below the ventilation outlet along a vertical direction.

3. The washing machine appliance of claim 1, further comprising:

a door movably attached to the cabinet to move between an open position permitting access to the opening and a closed position restricting access to the opening, the door defining an air aperture in upstream fluid communication with the ventilation line in the closed position.

4. The washing machine appliance of claim 1, wherein the front panel further defines a cabinet aperture spaced apart from the opening and in fluid communication with the tub upstream from the ventilation line.

5. The washing machine appliance of claim 4, further comprising:

a front baffle extending between the tub and the front panel; and a door movably attached to the cabinet to move between an open position permitting access to the opening and a closed position restricting access to the opening, the door comprising a central body and a perimeter rim extending outward from the central body, wherein the central body is in selective contact with the front baffle in the closed position, wherein the cabinet aperture is covered within a footprint of the door in the closed position, and wherein the perimeter rim is radially spaced apart from the cabinet aperture in the closed position to permit an ambient airflow to the cabinet aperture.

6. The washing machine appliance of claim 5, wherein the front baffle defines a radial aperture in fluid communication between the cabinet aperture and the tub.

7. The washing machine appliance of claim 1, wherein the antimicrobial body comprises an air-permeable mesh extending across the air path between the ventilation inlet and the ventilation outlet.

8. The washing machine appliance of claim 1, wherein the antimicrobial body forms the ventilation line defining the air path from the ventilation inlet to the ventilation outlet.

9. The washing machine appliance of claim 1, further comprising:

a front baffle extending between the tub and the front panel, the front baffle comprising an antimicrobial material.

10. The washing machine appliance of claim 1, further comprising:

a vent damper positioned in fluid communication with the ventilation line, the vent damper being selectively movable between a first position restricting airflow through the ventilation line and a second position permitting airflow through the ventilation line.

11. A washing machine appliance comprising:

a cabinet including a front panel, the front panel defining an opening and a cabinet aperture spaced apart from the opening;

a door movably attached to the cabinet to move between an open position and a closed position, the door in the open position permitting access to the opening, the door in the closed position defining a footprint on the front panel covering the opening and the cabinet aperture;

a tub positioned within the cabinet, the tub being in fluid communication with an ambient environment through the cabinet aperture in the closed position;

a wash basket rotatably mounted within the tub, the wash basket defining a wash chamber for receiving articles for washing;

a ventilation line in fluid communication with the tub downstream from the cabinet aperture, the ventilation line defining an air path from a ventilation inlet within the cabinet and to a ventilation outlet in fluid communication with the ambient environment outside of the cabinet;

an antimicrobial body positioned along the ventilation line; and a front baffle extending between the tub and the front panel, wherein the door comprises a central body and a perimeter rim extending outward from the central body, wherein the central body is in selective contact with the front baffle in the closed position, and wherein the perimeter rim is radially spaced apart from the cabinet aperture in the closed position to permit an ambient airflow to the cabinet aperture.

12. The washing machine appliance of claim 11, wherein the ventilation inlet is positioned below the ventilation outlet along a vertical direction.

13. The washing machine appliance of claim 11, wherein the front baffle defines a radial aperture in fluid communication between the cabinet aperture and the tub.

14. The washing machine appliance of claim 11, wherein the antimicrobial body comprises an air-permeable mesh extending across the air path between the ventilation inlet and the ventilation outlet.

15. The washing machine appliance of claim 11, wherein the antimicrobial body forms the ventilation line defining the air path from the ventilation inlet to the ventilation outlet.

16. The washing machine appliance of claim 11, wherein the front baffle comprises an antimicrobial material.

17. The washing machine appliance of claim 11, further comprising:

a vent damper positioned in fluid communication with the ventilation line, the vent damper being selectively movable between a first position restricting airflow through the ventilation line and a second position permitting airflow through the ventilation line.

18. A washing machine appliance comprising:

a cabinet including a front panel, the front panel defining an opening;

a tub positioned within the cabinet;

a wash basket rotatably mounted within the tub, the wash basket defining a wash chamber for receiving articles for washing;

a ventilation line in fluid communication with the tub, the ventilation line defining an air path from a ventilation inlet within the cabinet and to a ventilation outlet in fluid communication with an ambient environment outside of the cabinet; and an antimicrobial body comprising an air-permeable mesh extending across the air path between the ventilation inlet and the ventilation outlet.

19. The washing machine appliance of claim 18, further comprising:

a door movably attached to the cabinet to move between an open position permitting access to the opening and a closed position restricting access to the opening, the door defining an air aperture in upstream fluid communication with the ventilation line in the closed position.

20. The washing machine appliance of claim 18, wherein the front panel further defines a cabinet aperture spaced apart from the opening and in fluid communication with the tub upstream from the ventilation line.

* * * * *